US006319136B1

(12) United States Patent
Laijoki-Puska

(10) Patent No.: US 6,319,136 B1
(45) Date of Patent: Nov. 20, 2001

(54) METHOD AND APPARATUS IN A SPACE STUDY

(76) Inventor: Ritva Laijoki-Puska, Visamäki 5 E 37, FIN 02130 Espoo (FI)

( * ) Notice: Subject to any disclaimer, the term of this patent is extended or adjusted under 35 U.S.C. 154(b) by 0 days.

(21) Appl. No.: 09/341,997

(22) PCT Filed: Jan. 23, 1998

(86) PCT No.: PCT/FI98/00066

§ 371 Date: Oct. 19, 1999

§ 102(e) Date: Oct. 19, 1999

(87) PCT Pub. No.: WO98/33025

PCT Pub. Date: Jul. 30, 1998

(30) Foreign Application Priority Data

Jan. 23, 1997 (FI) ..... 970281

(51) Int. Cl.[7] ..... A63G 31/00
(52) U.S. Cl. ..... 472/65; 62/3.2
(58) Field of Search ..... 472/57, 59, 60, 472/65, 137; 62/3.2, 3.6

(56) References Cited

U.S. PATENT DOCUMENTS 3,681,896 8/1972 Velkoff .
5,407,392 4/1995 Laijoki-Puska .
5,565,067 10/1996 Chaffin, III .
5,841,064 * 11/1998 Maekawa et al. ..... 136/203

FOREIGN PATENT DOCUMENTS

0446528A2 9/1991 (EP) .
5214961 2/1977 (JP) .
1698600A1 4/1989 (SU) .
1550297A 3/1990 (SU) .

* cited by examiner

*Primary Examiner*—Kien T. Nguyen
(74) *Attorney, Agent, or Firm*—Birch, Stewart, Kolasch & Birch, LLP

(57) ABSTRACT

An apparatus for a space study generates visually impressive fluffy frost effects from the controlled freezing of water. This apparatus has transparent side walls and contains thermal elements and electrodes that can be either round or planar. The thermal elements can be Peltiers. Applying a DC voltage across the electrodes controls the generation of the artful frost effects. The apparatus can also contain, displays, illuminators and other components for enhancing the visual effect.

21 Claims, 2 Drawing Sheets

METHOD AND APPARATUS IN A SPACE STUDY

This application is the national phase under 35 U.S.C. §371 of PCT International Application No. PCT/FI98/00066 which has an International filing date of Jan. 23, 1998, which designated the United States of America. The invention relates to a method in a spatial work of art. The invention also relates to an arrangement in a spatial work of are. A spatial work of art is known from U.S. Pat. No. 5,407,392 wherein the work of art which is at least partially provided with transparent walls and includes cooling and heating elements for varying the temperature of the inside of the spatial work of art between a temperature below and a temperature above freezing temperature. By means of the arrangement, impressive phenomena are provided when water freezes and melts on a cyclic basis. The present invention aims at further developing the above-described solution and at achieving an entirely novel type of method and arrangement in a spatial work of art. The invention is based on generating an intense direct-current voltage field in the spatial work of art, said field controlling the formation of frost.

In more detail, the arrangement according to the invention pertains to a spatial work of art whose interior varies above and below the freezing point of water by generating an intense direct current voltage field inside the spatial work of art in order to control the generation of frost.

The arrangement according to the invention, then, has an inner part separated form the environment by at least one glass wall and cooling means (4, 20) for varying the temperature of the inner part below and above the freezing temperature of water.

The invention offers considerable benefits.

By means of the electric field, the formation of frost can be controlled and visually impressive "fluffy frost work" may be achieved.

In the following, the invention is described in more detail by means of embodiments in accordance with the annexed drawings.

Figure 1:
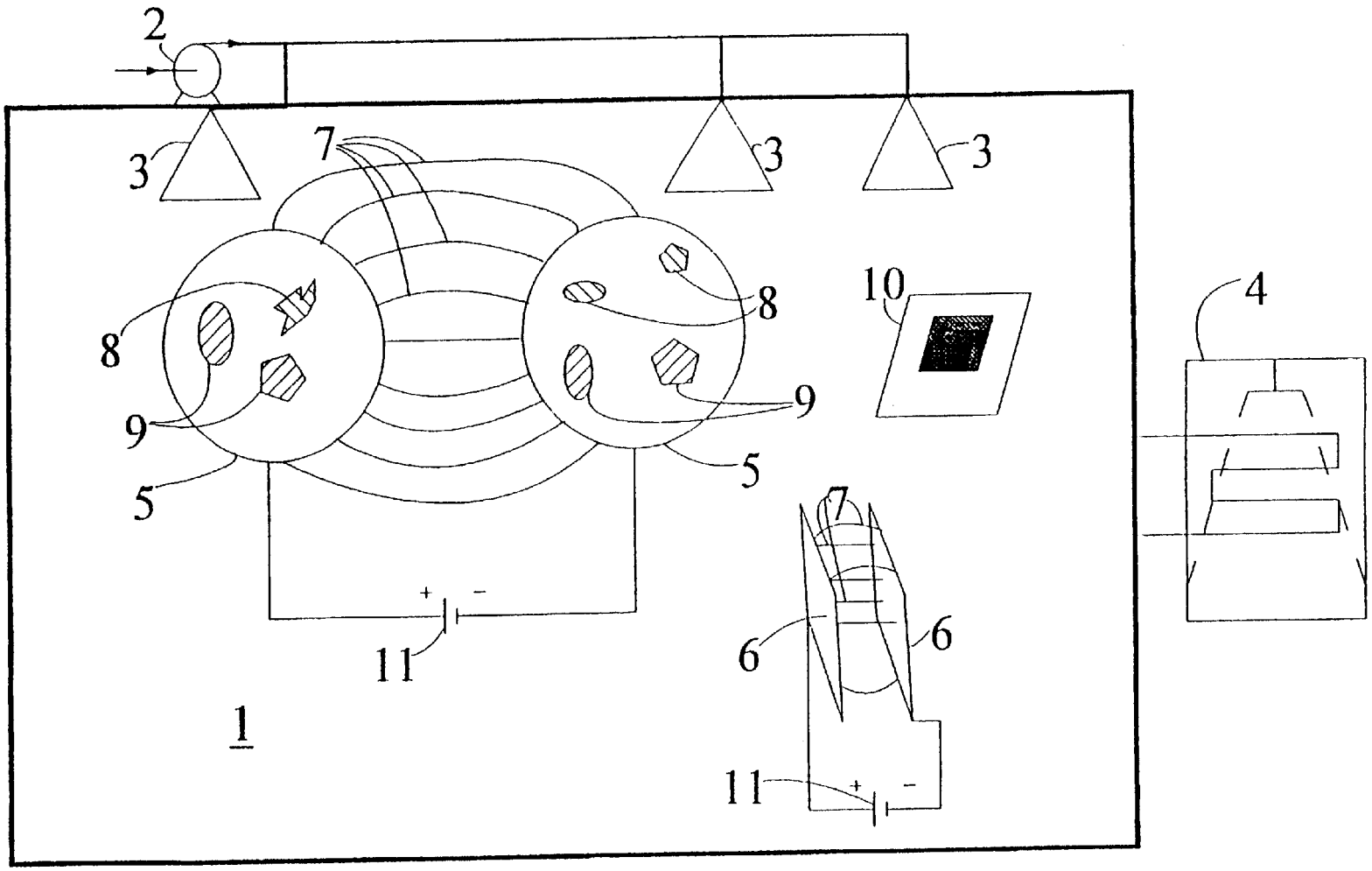
FIG. 1 is a schematic front view of a spatial work of art according to the invention.

In accordance with FIG. 1, the spatial work of art 1 comprises a structure resembling an aquarium wherein typically all side walls are transparent. The spatial work of art 1 is typically thermally as carefully sealed as possible such that thermal losses into the environment are minimized. Thus, the spatial work of art 1 is typically closed at the top by means of a too board. In order to render temperature changes possible, a thermal device 4 is coupled to the apparatus, capable of both heating and cooling the internal part of the spatial work of art 1. Said thermal device 4 typically comprises a compressor-type cooling apparatus of the kind used in refrigerators and freezers. By means of a medium, the cooling and heating effect is applied to desired targets inside the spatial work of art 1.

As target elements to be cooled/heated, spherical elements 5, flat elements 6 or devices 10 showing moving pictures, to cite a few examples, are provided inside the spatial work of art 1. The spatial work of art also incorporates a water pump 2 having a spout 3 for bringing water into the spatial work of art in the form of mist, drops, or a stream. The amount of water can naturally be regulated.

According to the invention, a direct voltage is provided between the spherical elements 5 by means of a voltage source 11. The same measure has also been performed for the flat elements 6. The voltage source 11 is advantageously controllable and the voltage may vary from zero to even discharge voltage depending on the distance between the electrodes 5 and 6 and the current drip situation. The electrodes 5 and 6 having opposed polarities are naturally electrically isolated from each other.

The targets to be observed, such as the spherical electrodes 5, may be provided with zones which can be heated 9 or cooled 8. The zones may form figures or texts.

The device 10 which shows moving pictures may comprise a conventional projector embedded in the structure of the apparatus, a cathode-ray tube or a flat display such as an electroluminescence display or a liquid crystal or plasma display. A cooling element may also be provided on the display 10 surface in order to enhance the impression created by the moving image.

Figure 2:
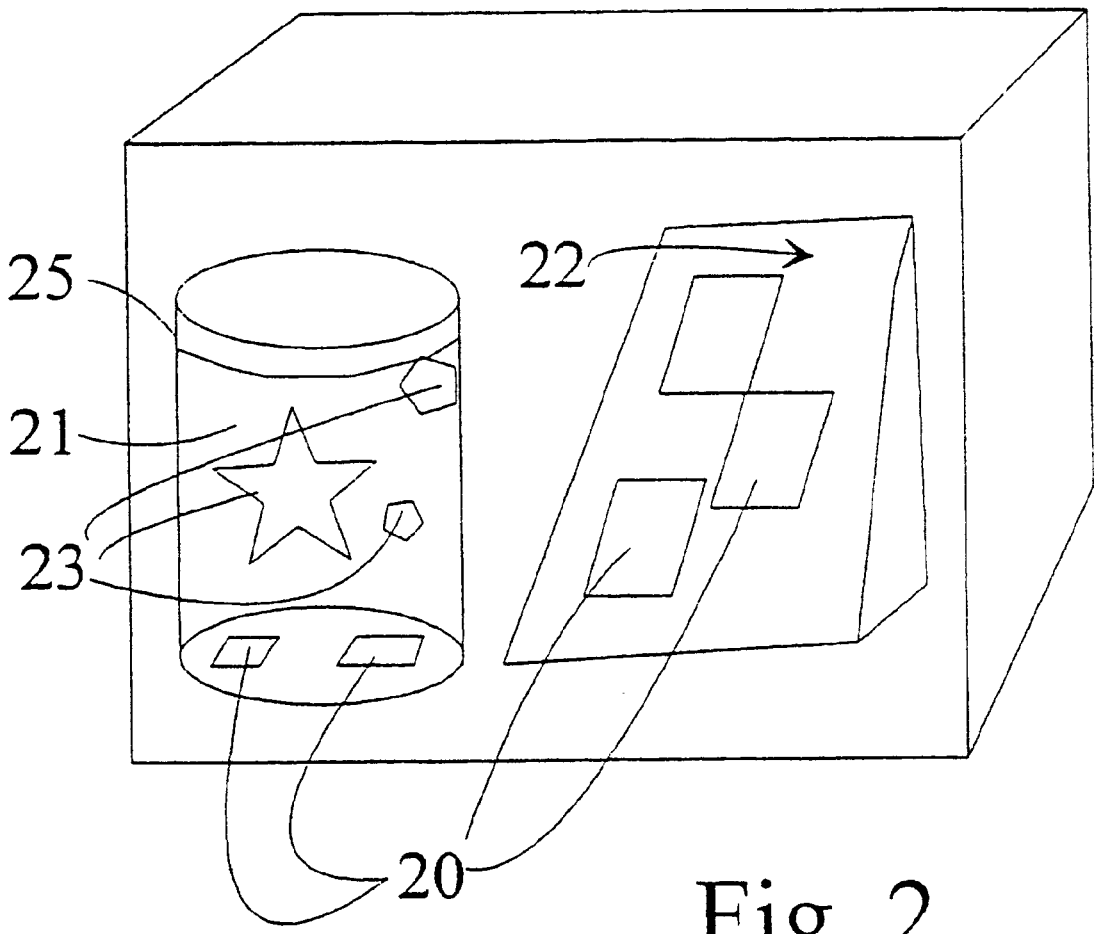
FIG. 2 is a perspective view of another spatial work of art according to the invention.

As will emerge from FIG. 2, even smaller aquarium-type spatial works of art are feasible, whereby Peltier elements 20 serve as the cooling/heating elements. Such elements are commercially available and they weigh a few dozen grams. When electric current is supplied to the element, part of it is cooled while part of it is heated. By reversing the direction of the current the cooling parts of the element can be heated, and vice versa. By suitably adapting such Peltier elements 20, a desired target can be both cooled and heated by means of electric current. In the Figure, some of the Peltier elements 20 are covered with plastic whose colour changes according to the temperature. In this manner, colour effects of a desired kind can be achieved. Peltier elements are also provided at the barrel 25 bottom, whereby the temperature of the liquid inside the barrel 25 can be varied by means thereof. The liquid 21 inside the barrel 25 may comprise water or advantageously a vegetable base oil having a congealing point which is higher than the freezing temperature of water. Preferably, rapeseed oil is used as the vegetable base oil. Due to the heat of transformation of oil which exceeds that of water, the transformation phenomena such as the formation of crystals 23 may be performed with less consumed energy. The splendour of the phenomena may be underlined by colouring the oil.

All walls of spatial works of art are typically transparent. However, all variations from one to four transparent walls are possible within the scope of the invention.

As a source of light in the spatial work of art, illuminators made of optical fibres may be used whereby no thermal power is transmitted to the spatial work of art.

The liquid in the barrel 25 may also be made to circulate in a cooled/heated circulation system which at least partly consists of a transparent material.

Some or all of the wall elements of the spatial work of art may be made semipermeable whereby the permeability of the mirrors as well as the visibility of the various details of the spatial work of art from the outside may be influenced by adjusting the level of illumination inside the spatial work of art.

What is claimed is:

1. A spatial work of art that comprises:

a structure separated from an outside environment by at least one glass side-wall;

at least one target element to be cooled or heated;

a thermal device for varying the temperature of an inner part of the structure below and above the freezing temperature of water;

a voltage source; and at least two electrodes connected to the voltage source, the electrodes capable of generating an electric field for enhancing and controlling frost congealing and formation events.

2. The spatial work of art of claim 1, wherein at least one of the electrodes is a spherical electrode.

3. The spatial work of art of claim 1, wherein at least one of the electrodes is a plane electrode.

4. The spatial work of art of claim 1, wherein all side walls are transparent.

5. The spatial work of art of claim 1, wherein the thermal device comprises a compressor cooling apparatus or at least one Peltier element.

6. The spatial work of art of claim 1, wherein the thermal device comprises Peltier elements that can be either heated or cooled by electric current.

7. The spatial work of art of claim 6, wherein at least one of the Peltier elements is covered with a plastic whose color changes according to the temperature.

8. The spatial work of art of claim 6, wherein at least one of the Peltier elements is disposed inside a barrel.

9. The spatial work of art of claim 8, wherein the barrel contains water or a vegetable oil having a congealing point higher than the freezing point of water.

10. The spatial work of art of claim 9, wherein the vegetable oil is rapeseed oil.

11. The spatial work of art of claim 1, wherein the at least one target comprises a spherical element, a flat element or a device showing moving pictures.

12. The spatial work of art of claim 11, wherein the device showing moving pictures comprises a cathode-ray tube, an electroluminescence display, a liquid crystal display or a plasma display.

13. The spatial work of art of claim 1, wherein the at least one target contains zones that can be heated or cooled.

14. The spatial work of art of claim 1, which further comprises a water pump having a spout for bringing water into the spatial work of art in the form of mist, drops or a stream.

15. The spatial work of art of claim 1, which further comprises a source of light.

16. The spatial work of art of claim 15, wherein the source of light comprises illuminators made of optical fibers.

17. A method for controlling frost formation in a spatial work of art, which comprises:

providing the spatial work of art which comprises a structure separated from an outside environment by at least one glass side-wall, at least one target element to be cooled or heated, a thermal device for varying the temperature of an inner part of the structure below and above the freezing temperature of water, a voltage source; and at least two electrodes connected to the voltage source, the electrodes capable of generating an electric field for enhancing and controlling frost congealing and formation events; and generating a direct-current voltage field inside the spatial work of art.

18. The method of claim 17, wherein at least one of the electrodes is a spherical electrode.

19. The method of claim 17, wherein at least one of the electrodes is a plane electrode.

20. The method of claim 17, wherein the voltage varies form zero to even discharge voltage.

21. The method of claim 17, wherein electrodes having opposed polarities are electrically isolated.

* * * * *